US010577559B2

(12) United States Patent
Al-Anazi et al.

(10) Patent No.: US 10,577,559 B2
(45) Date of Patent: Mar. 3, 2020

(54) PROCESS FOR DISTILLATION OF FATTY ACIDS FROM PALM KERN OIL FOR MINIMUM WASTE

(71) Applicant: L'Air Liquide, Société Anonyme pour l'Etude et l'Exploitation des Procédés Georges Claude, Paris (FR)

(72) Inventors: Flaiyh Farhan Al-Anazi, Riyadh (SA); Francisco Reyes, Riyadh (SA)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 0 days.

(21) Appl. No.: 16/468,797

(22) PCT Filed: Dec. 11, 2017

(86) PCT No.: PCT/IB2017/057802

§ 371 (c)(1),
(2) Date: Jun. 12, 2019

(87) PCT Pub. No.: WO2018/109644

PCT Pub. Date: Jun. 21, 2018

(65) Prior Publication Data

US 2019/0300819 A1 Oct. 3, 2019

Related U.S. Application Data

(60) Provisional application No. 62/432,789, filed on Dec. 12, 2016.

(51) Int. Cl.

| | |
|---|---|
| ***C11B 3/12*** | (2006.01) |
| ***C11B 1/10*** | (2006.01) |
| ***C11C 1/00*** | (2006.01) |
| ***C11C 1/10*** | (2006.01) |

(52) U.S. Cl.
CPC ..... *C11B 3/12* (2013.01); *C11B 1/10* (2013.01); *C11C 1/005* (2013.01); *C11C 1/10* (2013.01)

(58) Field of Classification Search
CPC ... C11B 3/12; C11B 1/10; C11C 1/005; C11C 1/10
USPC ..... 554/8
See application file for complete search history.

(56) References Cited

U.S. PATENT DOCUMENTS 2,351,249 A * 6/1944 Zeigler ..... C11C 1/005 554/209
5,892,072 A * 4/1999 Thode ..... C07C 51/44 554/175

FOREIGN PATENT DOCUMENTS

EP 2 172 442 4/2010
EP 2172442 A1 * 4/2010 ..... C07C 51/43
WO WO 2009 085324 7/2009
(Continued)

OTHER PUBLICATIONS

International Search Report and Written Opinion for corresponding PCT/IB2017/057802, dated Mar. 1, 2018.

*Primary Examiner* — Deborah D Carr
(74) *Attorney, Agent, or Firm* — Elwood L. Haynes

(57) ABSTRACT

A feed stream comprising fatty acids with chain lengths C6 to C20 is distilled in a first column to provide a C6-C8 top cut, a C8-C10 middle cut and a C12+ bottom cut, said C12+ bottom cut being distilled in a second column to provide a C12-C14 top cut and a C16+ bottom cut, said C16+ bottom cut being distilled in a third column to provide a C16-C18 top cut and a C18+ bottom cut.

16 Claims, 3 Drawing Sheets

(56) References Cited

FOREIGN PATENT DOCUMENTS

WO WO-2009085324 A1 * 7/2009 ..... C10L 1/02

* cited by examiner

FIG. 2A
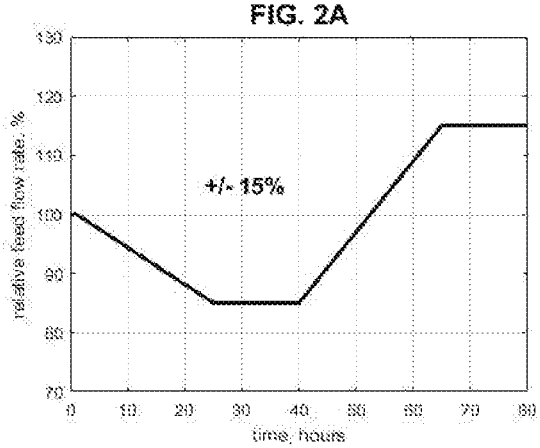
FIG. 2B
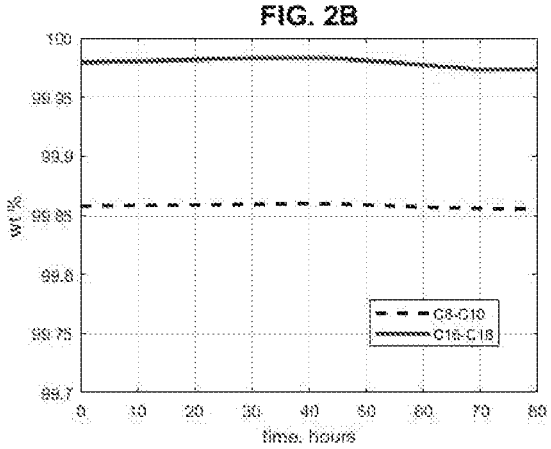
FIG. 2C
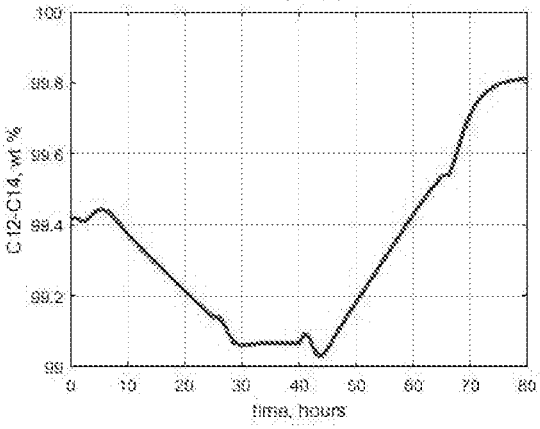
FIG. 2D
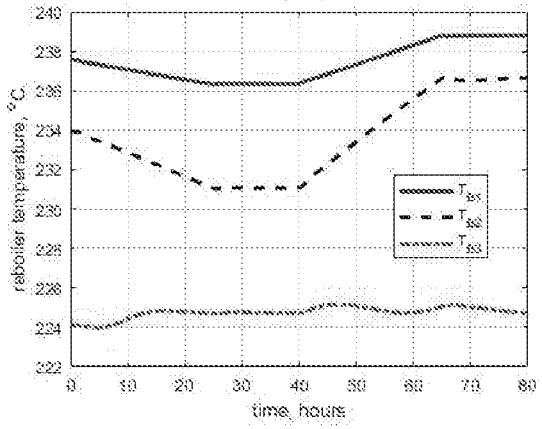
FIGS. 2A-2D FIG. 3A
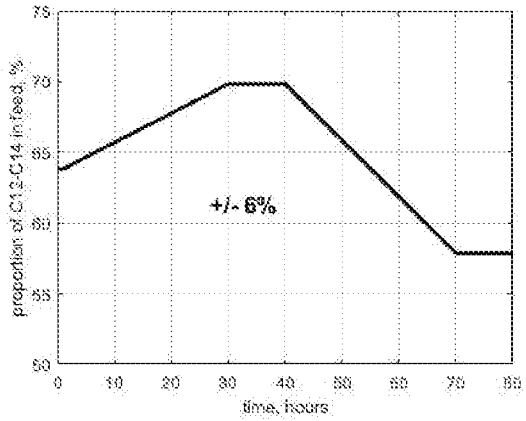
FIG. 3B
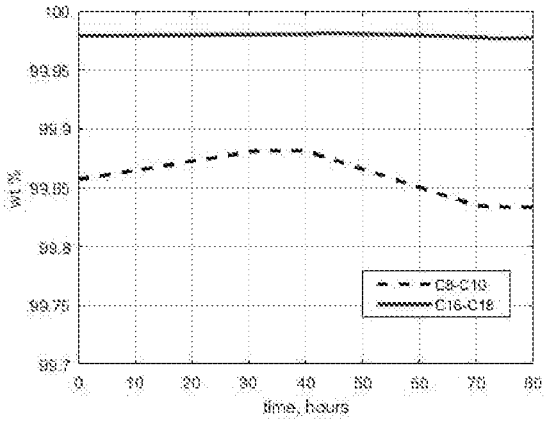
FIG. 3C
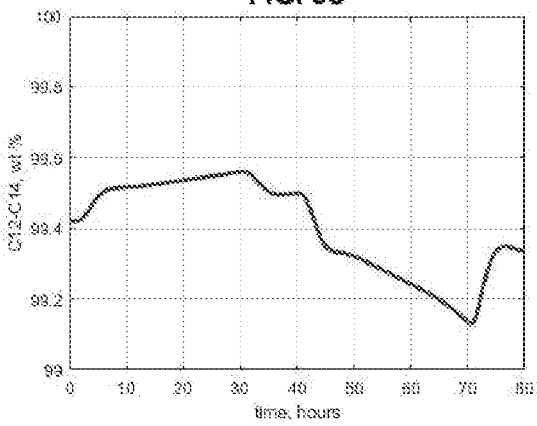
FIG. 3D
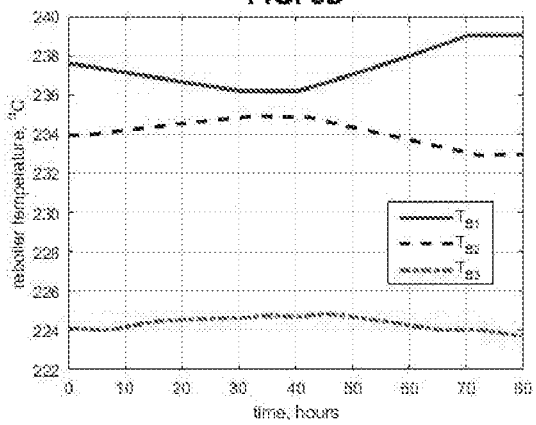
FIGS. 3A-3D

PROCESS FOR DISTILLATION OF FATTY ACIDS FROM PALM KERN OIL FOR MINIMUM WASTE

CROSS REFERENCE TO RELATED APPLICATIONS

The present application is a 371 of International PCT Application No. PCT/IB2017/057802, filed Dec. 11, 2017, which claims the benefit of priority from U.S. Provisional Patent Application No. 62/432,789 filed Dec. 12, 2016, hereby incorporated by reference in its entirety for all purposes.

BACKGROUND

Fatty acids are an industrial commodity of commercial significance. Industries that consume large amounts of fatty acids include the grease and lubricant industry, the rubber industry, the soap and cosmetic industry, and the textile industry. Fatty acids can serve as activators, accelerators, softening agents, waxes, cooking oils, and numerous other commercially significant products.

The distillation of fatty acids presents many engineering challenges. For instance, fatty acid distillation often requires numerous intermediate separation steps that produce unwanted secondary products. These unwanted cuts must then be recycled by external processes that are cumbersome and inefficient. Furthermore, when the number of process steps increases, the amount of waste, resources, and plant equipment such as piping, tanks, and valves also increases. The fatty acid distillation process can also be complicated to control. Desired product purity levels can often only be achieved through the manipulation of numerous variables such as temperature, flow rate, pressure, and stream composition. This results in a process that requires more time and resources to operate.

Thus, there is a need for a simplified methods of distillation that can produce high purity fatty acid products in a minimum number of process steps and requires only minimum input for control.

SUMMARY

Certain embodiments are directed to methods of fatty acid distillation using indirect distillation and inferential controls. The method comprising: passing a feed stream comprising a glyceride or fatty acid through a first column; distributing a C6-C8 cut to a top portion of the first column; distributing a C8-C10 cut to a middle portion or side arm of the first column; withdrawing a C12+ cut from a bottom portion of the first column and passing the C12+ cut through a second column; distributing a C12-C14 cut to a top portion of the second column; withdrawing a C16+ cut from a bottom portion of the second column and passing the C16+ cut through a third column; distributing a C16-C18 cut to a top portion of the third column; and distributing a C18+ cut to a bottom portion of the third column. In certain aspects the feed stream comprises a vegetable oil. In a particular aspect the feed stream comprises palm kernel oil.

The method can further comprise withdrawing the C6-C8 cut from the top portion of the first column; and withdrawing the C8-C10 cut from the middle portion or side arm of the first column. In certain aspects the purity of the C8-C10 cut is greater than or equal to 99.0% by weight. In particular aspects the purity of the C8-C10 is greater than or equal to 99.8% by weight.

The method can further comprise withdrawing the C12-C14 cut from the top portion of the second column. In certain aspects the purity of the C12-C14 cut is greater than or equal to 99.0% by weight.

In a further aspect the methods can further comprise withdrawing the C16-C18 cut from the top portion of the third column. In certain aspects the purity of the C16-C18 cut is greater than or equal to 99.0% by weight. In a particular aspect preferably wherein the purity of the C16-C18 cut is greater than or equal to 99.9% by weight.

In certain aspects the method can comprise a temperature controller setting the flowrate of the C8-C10 cut based on temperature readings at some convenient location inside the first column. In further aspects the method can further comprise a temperature controller to set the flowrate of the C16+ cut based on the temperature at some convenient location inside the second column. In still a further aspect the method can further comprise a temperature controller to set the flowrate of the C18+ cut based on the temperature at some convenient location inside the third column.

In other aspects the method can use a reboiler temperature that is less than or equal to 240° C. for the first column. In still a further aspect the first column can be operated at a pressure of 9 to 15 kPa and a temperature of 140 to 235° C. In certain aspects the second column can be operated at a pressure of 1 to 4 kPa and a temperature of 175 to 232° C. In a further aspect the third column can be operated at a pressure of 0.3 to 1 kPa and a temperature of 187 to 224° C.

Certain embodiments are directed to methods of fatty acid distillation, comprising: passing a feed stream comprising palm kernel oil through a first column; distributing a C6-C8 cut to a top portion of the first column and withdrawing the C6-C8 cut from the top portion of the first column; distributing a C8-C10 cut to a middle portion of the first column and withdrawing the C8-C10 cut from the middle portion of the first column, wherein a purity of the C8-C10 cut is greater than or equal to 99.8% by weight; withdrawing a C12+ cut from a bottom portion of the first column and passing the C12+ cut through a second column; distributing a C12-C14 cut to a top portion of the second column and withdrawing the C12-C14 cut from the top portion of the second column, wherein a purity of the C12-C14 cut is greater than or equal to 99% by weight; withdrawing a C16+ cut from a bottom portion of the second column and passing the C16+ cut through a third column; distributing a C16-C18 cut to a top portion of the third column and withdrawing the C16-C18 cut from the top portion of the third column, wherein a purity of the C16-C18 cut is greater than or equal to 99.9% by weight; and distributing a C18+ cut to a bottom portion of the third column.

Other embodiments of the invention are discussed throughout this application. Any embodiment discussed with respect to one aspect of the invention applies to other aspects of the invention as well and vice versa. Each embodiment described herein is understood to be embodiments of the invention that are applicable to all aspects of the invention. It is contemplated that any embodiment discussed herein can be implemented with respect to any method or composition of the invention, and vice versa. Furthermore, compositions and kits of the invention can be used to achieve methods of the invention.

The use of the word "a" or "an" when used in conjunction with the term "comprising" in the claims and/or the specification may mean "one," but it is also consistent with the meaning of "one or more," "at least one," and "one or more than one."

Throughout this application, the term "about" is used to indicate that a value includes the standard deviation of error for the device or method being employed to determine the value.

The use of the term "or" in the claims is used to mean "and/or" unless explicitly indicated to refer to alternatives only or the alternatives are mutually exclusive, although the disclosure supports a definition that refers to only alternatives and "and/or."

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

In the context of the present invention, seventeen embodiments are now described. Embodiment 1 is a method of fatty acid distillation, the method including the steps of passing a feed stream containing fatty acids with chain lengths of C6 to C20 through a first column; distributing a C6-C8 cut to a top portion of the first column; distributing a C8-C10 cut to a middle portion of the first column; withdrawing a C12+ cut from a bottom portion of the first column and passing the C12+ cut through a second column; distributing a C12-C14 cut to a top portion of the second column; withdrawing a C16+ cut from a bottom portion of the second column and passing the C16+ cut through a third column; distributing a C16-C18 cut to a top portion of the third column; and distributing a C18+ cut to a bottom portion of the third column. Embodiment 2 is the method of embodiment 1, wherein the feed stream contains a vegetable oil. Embodiment 3 is the method of embodiment 2, wherein the feed stream contains palm kernel oil. Embodiment 4 is the method of any of the preceding embodiments, further includes withdrawing the C6-C8 cut from the top portion of the first column; and withdrawing the C8-C10 cut from the middle portion of the first column. Embodiment 5 is the method of embodiment 4, wherein a purity of the C8-C10 cut is greater than or equal to 99.0% by weight, preferably wherein the purity is greater than or equal to 99.8% by weight. Embodiment 6 is the method of any of embodiments 1 to 5, further including withdrawing the C12-C14 cut from the top portion of the second column. Embodiment 7 is the method of embodiment 6, wherein a purity of the C12-C14 cut is greater than or equal to 99.0% by weight, preferably wherein the purity of the C12-C14 cut is greater than or equal to 99.6% by weight. Embodiment 8 is the method of any of embodiments 1 to 7, further includes withdrawing the C16-C18 cut from the top portion of the third column. Embodiment 9 is the method of embodiment 8, wherein a purity of the C16-C18 cut is greater than or equal to 99.0% by weight, preferably wherein the purity of the C16-C18 cut is greater than or equal to 99.9% by weight. Embodiment 10 is the method of any of embodiments 1 to 9, wherein the method is compatible with inferential composition control. Embodiment 11 is the method of embodiments 1 to 10, further including a temperature controller in communication with the first column and the C8-C10 cut. Embodiment 12 is the method of any of embodiments 1 to 11, further including a temperature controller in communication with the second column and the C16+ cut. Embodiment 13 is the method of any of embodiments 1 to 12, further including a temperature controller in communication with the third column and the C18+ cut. Embodiment 14 is the method of any of embodiments 1 to 13, wherein a reboiler temperature is less than or equal to 240° C. for the first column, second column, third column, or a combination including at least one of the foregoing. Embodiment 15 is the method of any of embodiments 1 to 14, wherein the first column is operated at a pressure of 10 to 12 kPa and a temperature of 140 to 238° C.; the second column is operated at a pressure of 1.2 to 2.5 kPa and a temperature: 175 to 234° C.; and the third column is operated at a pressure of 0.3 to 0.7 kPa and a temperature of 187 to 224° C.

Embodiment 16 is a method of fatty acid distillation. The method of embodiment 17 includes the steps of passing a feed stream containing palm kernel oil through a first column; distributing a C6-C8 cut to a top portion of the first column and withdrawing the C6-C8 cut from the top portion of the first column; distributing a C8-C10 cut to a middle portion of the first column and withdrawing the C8-C10 cut from the middle portion of the first column, wherein a purity of the C8-C10 cut is greater than or equal to 99.8% by weight; withdrawing a C12+ cut from a bottom portion of the first column and passing the C12+ cut through a second column; distributing a C12-C14 cut to a top portion of the second column and withdrawing the C12-C14 cut from the top portion of the second column, wherein a purity of the C12-C14 cut is greater than or equal to 99.6% by weight; withdrawing a C16+ cut from a bottom portion of the second column and passing the C16+ cut through a third column; distributing a C16-C18 cut to a top portion of the third column and withdrawing the C16-C18 cut from the top portion of the third column, wherein a purity of the C16-C18 cut is greater than or equal to 99.9% by weight; and distributing a C18+ cut to a bottom portion of the third column.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

DESCRIPTION OF THE DRAWINGS

The following drawings form part of the present specification and are included to further demonstrate certain aspects of the present invention. The invention may be better understood by reference to one or more of these drawings in combination with the detailed description of the specification embodiments presented herein.

FIGS. 2A-2D are graphical representations of the results from a fatty acid distillation simulation.

FIGS. 3A-3D are graphical representations of the results from a fatty acid distillation simulation.

DESCRIPTION

Figure 1:
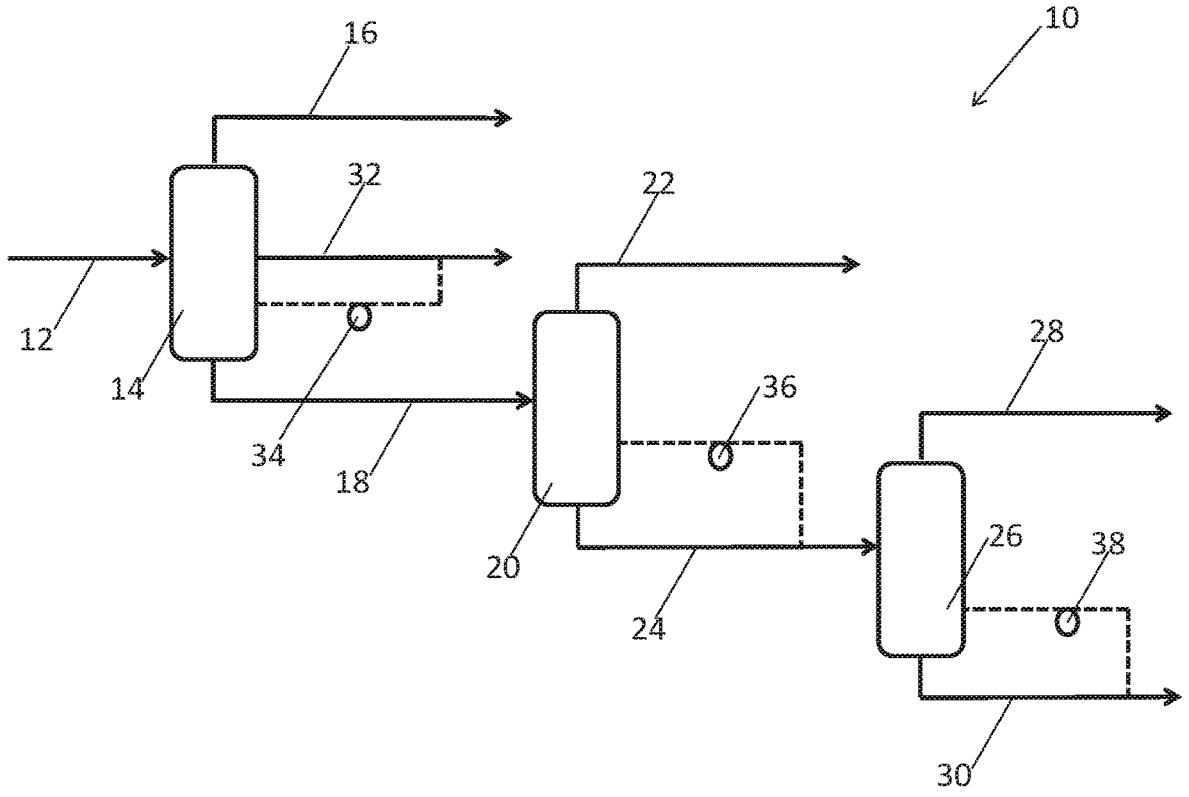
FIG. 1 is a schematic diagram representing a method for fatty acid distillation.

The method disclosed herein can provide a simplified method of distillation that can produce high purity fatty acid products in a minimum number of process steps using minimal input for control. The method disclosed herein can significantly reduce the number of intermediate steps required to produce high purity fatty acids. In certain aspects fewer waste streams and secondary streams are produced. In a further aspect less than or equal to three distillation steps are required. In particular aspects C10-C12 and C14-C16 cuts and/or fractions are not generated or required. As a result, fewer resources are expended on recycling unwanted streams. In certain configurations the methods require fewer external recycling processes. Furthermore, since the total number of streams is reduced and the secondary streams contain only components too light or too heavy for inclusion in the final products, the overall process operates with minimum waste and maximum efficiency. The methods disclosed herein also can require less overall process equipment. Certain configurations utilize fewer columns, pipes, valves, tanks, controllers, and other components for operation. The method disclosed herein also requires less input for control. In certain aspects the methods are compatible with and incorporate inferential composition control. Inferential composition control refers to a control mechanism that indirectly controls a composition by controlling some temperature that exhibits a one-to-one correspondence with this composition. In certain aspects product purities can be maintained using only distillation column temperature measurements. As a result, less time and fewer resources are required for operation. The method disclosed herein can produce high purity fatty acid products. Fatty acid products of greater than or equal to 90%, 99%, 99.6%, 99.8%, or 99.9% purity can be achieved.

A method of fatty acid distillation can include passing a feed stream comprising a glyceride or fatty acid through a first column. A C6-C8 cut can be distributed to a top portion of the first column, a C8-C10 cut can be distributed to a middle portion or side arm of the first column, and a C12+ cut can be distributed to a bottom portion of the first column. A method of fatty acid distillation can include withdrawing a C12+ cut from a bottom portion of the first column and passing the C12+ cut through a second column. A C12-C14 cut can be distributed to a top portion of the second column and a C16+ cut can be distributed to a bottom portion of the second column. A C16+ cut can further be withdrawn from a bottom portion of the second column and passed through a third column. A method of fatty acid distillation can include distributing a C16-C18 cut to a top portion of the third column and distributing a C18+ cut to a bottom portion of the third column.

The method disclosed herein can include a feed stream. In certain aspects the feed stream can comprise a glyceride, a mixture of glycerides, a fatty acid, or a mixture of fatty acids. In certain aspects the feed stream can comprise C6+ fatty acids, e.g., C6-C20+ fatty acids. In further aspects the feed steam can comprise octanoic fatty acids, decanoic fatty acids, dodecanoic fatty acids, tetradecanoic fatty acids, hexadecanoic fatty acids, octadecanoic fatty acids, or a combination comprising at least one of the foregoing. In certain aspects the feed stream can comprise vegetable oils. In particular aspects the feed stream can comprise coconut oil, corn oil, cottonseed oil, palm oil, peanut oil, rapeseed oil, safflower oil, sesame oil, sunflower oil, palm kernel oil, or a combination comprising at least one of the foregoing. In certain aspects the feed stream can comprise palm kernel oil.

One method described herein can comprise passing a feed stream through a first distillation column. The first column can distribute a C6-C8 cut and/or fraction to a top portion of the first column. The C6-C8 cut can comprise hexanoic to octanoic fatty acids. The first column can distribute a C8-C10 cut to a middle portion or side arm of the first column. The C8-C10 cut can comprise octanoic to decanoic fatty acids. An inferential composition control scheme can be used to set the flow of the C8-C10 cut stream based on the temperature at some convenient location inside the first column. Using only temperature measurements, the purity level of the C8-C10 cut stream can be maintained at greater than or equal to 99.8% by weight for typical variations in the feed composition and feed flowrate, as proved in the attached simulation results.

The first column can distribute a C12+ cut to a bottom portion of the first column. The C12+ cut can comprise dodecanoic, tetradecanoic, palmitic, stearic, oleic, linoleic, and eicosanoic fatty acids. The pressure inside the first column can vary from 9 to 15 kPa. The temperature inside the first column can vary from 140 to 235° C. The reboiler temperature for the first column can be less than or equal to 240° C. In particular aspects, the reboiler temperature is less than or equal to 238° C.

The C12+ cut stream can be passed through a second distillation column. The second column can distribute a C12-C14 cut to a top portion of the column. The C12-C14 cut can comprise dodecanonic to tetradecanoic fatty acids. The second column can distribute a C16+ cut to a bottom portion of the column. The C16+ cut can comprise palmitic, stearic, oleic, linoleic, and eicosanoic fatty acids.

An inferential composition control scheme can be used to set the flow of the C16+ cut stream based on the temperature at some convenient location inside the second column. Using only temperature measurements, the purity level of the C12-C14 cut stream can be maintained at greater than or equal to 99% by weight for typical variations in the feed composition and feed flowrate, as proved in the attached simulation results. The pressure inside the second column can vary from 1 to 4 kPa. The temperature inside this column can vary from 174 to 232° C. A reboiler temperature for the second column can be less than or equal to 240° C. In particular aspects the reboiler temperature is less than or equal to 234° C.

The C16+ stream can be passed through a third distillation column. The third column can distribute a C16-C18 cut to a top portion of the third column. The C16-C18 cut can comprise palmitic, stearic, oleic, and linoleic fatty acids. The third column can distribute a C18+ cut to a bottom portion of the third column. The C18+ cut can comprise stearic, oleic, linoleic, and eicosanoic fatty acids.

An inferential composition control scheme can be used to set the flow of the C18+ cut stream based on the temperature at some convenient location inside the third column. Using only temperature measurements, the purity level of the C16-C18 cut stream can be maintained at greater than or equal to 99.9% by weight for typical variations in the feed composition and feed flowrate, as proved in the attached simulation results. The pressure inside the third column can vary from 0.3 to 1 kPa. The temperature inside this column can vary from 187 to 224° C. In a further aspect the reboiler temperature for the third column can be less than or equal to 228° C. In still a further aspect the reboiler temperature for the third column can be less than or equal to 225° C.

A more complete understanding of the components, processes, and apparatuses disclosed herein can be obtained by reference to the accompanying drawings. Certain figures are merely schematic representations based on convenience and the ease of demonstrating the present disclosure, and are, therefore, not intended to indicate relative size and dimensions of the devices or components thereof and/or to define or limit the scope of the exemplary embodiments. Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

Referring now to FIG. 1, this simplified schematic diagram represents a method 10 for fatty acid distillation. The method can include passing feed stream 12 through first column 14. In certain aspects feed stream 12 can comprise one or more of glyceride, a mixture of glycerides, fatty acids, a mixture of fatty acids. In certain aspects feed stream 12 can comprise palm kernel oil. The first distillation column 14 can distribute a C6-C8 cut and/or fraction to a top portion of the column 14. For example, the C6-C8 cut can comprise hexanoic to octanoic fatty acids. The C6-C8 cut can be withdrawn from the first column 14 through C6-C8 cut stream 16.

The first column can distribute a C8-C10 cut to a middle portion of the first column 14. For example, the C8-C10 cut can comprise octanoic to decanoic fatty acids. The C8-C10 cut can be withdrawn from the first column through a C8-C10 cut stream 32. A first temperature controller 34 for inferential composition control can be present and in communication with the first column 14 and the C8-C10 cut stream 32. For example, the C12+ cut can comprise dodecanoic, tetradecanoic, palmitic, stearic, oleic, linoleic, and eicosanoic fatty acids. The C12+ cut can be withdrawn from the bottom portion of the first column 14 through C12+ cut stream 18.

The C12+ cut stream 18 can be passed through a second distillation column 20. The second column 20 can distribute a C12-C14 cut to a top portion of the column 20. For example, the C12-C14 cut can comprise dodecanonic to tetradecanoic fatty acids. The C12-C14 cut can be withdrawn from the second column 20 through C12-C14 cut stream 22. The second column 20 can distribute a C16+ cut to a bottom portion of the column 20. For example, the C16+ cut can comprise palmitic, stearic, oleic, linoleic, and eicosanoic fatty acids. The C16+ cut can be withdrawn from the bottom portion of the second column 20 through C16+ cut stream 24. A second temperature controller 36 for inferential composition control can be present and in communication with the second column 20 and the C16+ cut stream 24.

The C16+ cut stream 24 can be passed through a third distillation column 26. The third column 26 can distribute a C16-C18 cut to a top portion of the column 26. For example, the C16-C18 cut can comprise palmitic to octadecanoic fatty acids. The C16-C18 cut can be withdrawn from the third column 26 through the C16-C18 cut stream 28. The third column 26 can distribute a C18+ cut to a bottom portion of the column 26. For example, the C18+ cut can comprise stearic, oleic, linoleic, and eicosanoic fatty acids. The C18+ cut can be withdrawn from the bottom portion of the third column 26 through C18+ cut stream 30. A third temperature controller 38 for inferential composition control can be present and in communication with the third column 26 and the C18+ cut stream 30.

The following examples are merely illustrative of the separation method disclosed herein and is not intended to limit the scope invention described herein.

Simulations of a fatty acid distillation method in accordance with the present disclosure (as depicted in FIG. 1) were conducted using Aspen Plus simulation computer software. Steady-state and dynamic models were used. No tuning was required other than for the three temperature controllers where their inherent measurement lags were modelled as 5 minute dead times.

FIG. 2 depicts the effects of +/−15% ramped variations in the feed flowrate to the process. FIG. 2B shows that a purity level greater than or equal to 99.8% by weight can be maintained for the C8-C10 and C16-C18 cuts. In the case of the C12-C14 cut, FIG. 2C indicates that the purity level can be kept higher than 99% by weight. These levels of purities are maintained by temperature controllers, as previously discussed, without the need of changes in their corresponding set points or retuning. FIG. 2D shows that the reboiler temperatures of all columns do not exceed 240° C.

FIG. 3 depicts the impact of changes in the feed composition, where the proportion of C12-C14 is manipulated in ramped variations within the range+/−6%. FIG. 3B shows that a purity level greater than or equal to 99.8% by weight can be maintained for the C8-C10 and C16-C18 cuts. In the case of the C12-C14 cut, FIG. 3C indicates that the purity level can be kept higher than 99% by weight. These levels of purities are maintained by temperature controllers, as previously discussed, without the need of changes in their corresponding set points or retuning. FIG. 2D shows that the reboiler temperatures of all columns do not exceed 240° C.

The invention claimed is:

1. A method of fatty acid distillation, comprising:

passing a feed stream comprising fatty acids with chain lengths C6 to C20 through a first column;

distributing a C6-C8 cut to a top portion of the first column;

distributing a C8-C10 cut to a middle portion of the first column;

withdrawing a C12+ cut from a bottom portion of the first column and passing the C12+ cut through a second column;

distributing a C12-C14 cut to a top portion of the second column;

withdrawing a C16+ cut from a bottom portion of the second column and passing the C16+ cut through a third column;

distributing a C16-C18 cut to a top portion of the third column; and distributing a C18+ cut to a bottom portion of the third column.

2. The method of claim 1, wherein the feed stream comprises a vegetable oil.

3. The method of claim 2, wherein the feed stream comprises palm kernel oil.

4. The method of claim 1, further comprising:

withdrawing the C6-C8 cut from the top portion of the first column; and withdrawing the C8-C10 cut from the middle portion of the first column.

5. The method of claim 4, wherein a purity of the C8-C10 cut is greater than or equal to 99.0% by weight.

6. The method of claim 1, further comprising withdrawing the C12-C14 cut from the top portion of the second column.

7. The method of claim 6, wherein a purity of the C12-C14 cut is greater than or equal to 99.0% by weight.

8. The method of claim 1, further comprising withdrawing the C16-C18 cut from the top portion of the third column.

9. The method of claim 8, wherein a purity of the C16-C18 cut is greater than or equal to 99.0% by weight.

10. The method of claim 1, wherein the method is compatible with inferential composition control.

11. The method of claim 1, further comprising a temperature controller in communication with the first column and the C8-C10 cut.

12. The method of claim 1, further comprising a temperature controller in communication with the second column and the C16+ cut.

13. The method of claim 1, further comprising a temperature controller in communication with the third column and the C18+ cut.

14. The method of claim 1, wherein a reboiler temperature is less than or equal to 240° C. for the first column, second column, third column, or a combination comprising at least one of the foregoing.

15. The method of claim 1, wherein the first column is operated at a pressure of 9 to 15 kPa and a temperature of 140 to 235° C.; the second column is operated at a pressure of 1 to 4 kPa and a temperature: 175 to 232° C.; and the third column is operated at a pressure of 0.3 to 1 kPa and a temperature of 187 to 224° C.

16. A method of fatty acid distillation, comprising:

passing a feed stream comprising palm kernel oil through a first column;

distributing a C6-C8 cut to a top portion of the first column and withdrawing the C6-C8 cut from the top portion of the first column;

distributing a C8-C10 cut to a middle portion of the first column and withdrawing the C8-C10 cut from the middle portion of the first column, wherein a purity of the C8-C10 cut is greater than or equal to 99.8% by weight;

withdrawing a C12+ cut from a bottom portion of the first column and passing the C12+ cut through a second column;

distributing a C12-C14 cut to a top portion of the second column and withdrawing the C12-C14 cut from the top portion of the second column, wherein a purity of the C12-C14 cut is greater than or equal to 99% by weight;

withdrawing a C16+ cut from a bottom portion of the second column and passing the C16+ cut through a third column;

distributing a C16-C18 cut to a top portion of the third column and withdrawing the C16-C18 cut from the top portion of the third column, wherein a purity of the C16-C18 cut is greater than or equal to 99.9% by weight; and distributing a C18+ cut to a bottom portion of the third column.

* * * * *